US005743069A

United States Patent [19]

Ansaloni

[11] Patent Number: 5,743,069

[45] Date of Patent: Apr. 28, 1998

[54] METERING MACHINE

[75] Inventor: Angelo Ansaloni, Crespellano, Italy

[73] Assignee: MG2 S.p.A., Pian di Macina-Pianoro, Italy

[21] Appl. No.: 808,996

[22] Filed: Mar. 3, 1997

[30] Foreign Application Priority Data

Mar. 4, 1996 [IT] Italy ..... BO96A0105

[51] Int. Cl.[6] ..... B65B 1/04; B65B 43/50

[52] U.S. Cl. ..... 53/282; 53/167; 53/900

[58] Field of Search ..... 53/281, 282, 900, 53/468, 266.1, 272, 564, 167

[56] References Cited

U.S. PATENT DOCUMENTS

| | | | |
|---|---|---|---|
| 2,630,953 | 3/1953 | Kath | 53/281 |
| 3,070,932 | 1/1963 | Hofliger | 53/281 |
| 4,731,979 | 3/1988 | Yamamoto et al. | 53/281 X |
| 4,782,644 | 11/1988 | Haarer et al. | 53/900 X |
| 4,959,943 | 10/1990 | Yamamoto et al. | 53/282 |
| 4,991,377 | 2/1991 | Marchesini | 53/900 X |
| 5,018,335 | 5/1991 | Yamamoto et al. | 53/281 |
| 5,054,258 | 10/1991 | Tait et al. | 53/900 X |
| 5,081,822 | 1/1992 | Boyd et al. | 53/281 X |
| 5,094,184 | 3/1992 | Yamamoto et al. | 53/900 X |
| 5,474,092 | 12/1995 | Moser et al. | 53/900 X |

*Primary Examiner*—Horace M. Culver
*Attorney, Agent, or Firm*—Finnegan, Henderson, Farabow, Garrett & Dunner, L.L.P.

[57] ABSTRACT

A metering machine for filling capsules, each capsule having a hollow bottom shell and a hollow lid fitting one inside the other; the machine having a filling assembly for filling the capsules; the filling assembly having, successively in a preferred traveling direction of the capsules, an opening device for opening the capsules, a metering device, and a closing device for closing the capsules; the filling assembly also having a control device for ascertaining opening of the capsules, and a cleaning device for cleaning first and second seats respectively housing the bottom shells and the lids; and the control and cleaning devices cooperating with each other via a central control unit.

11 Claims, 2 Drawing Sheets

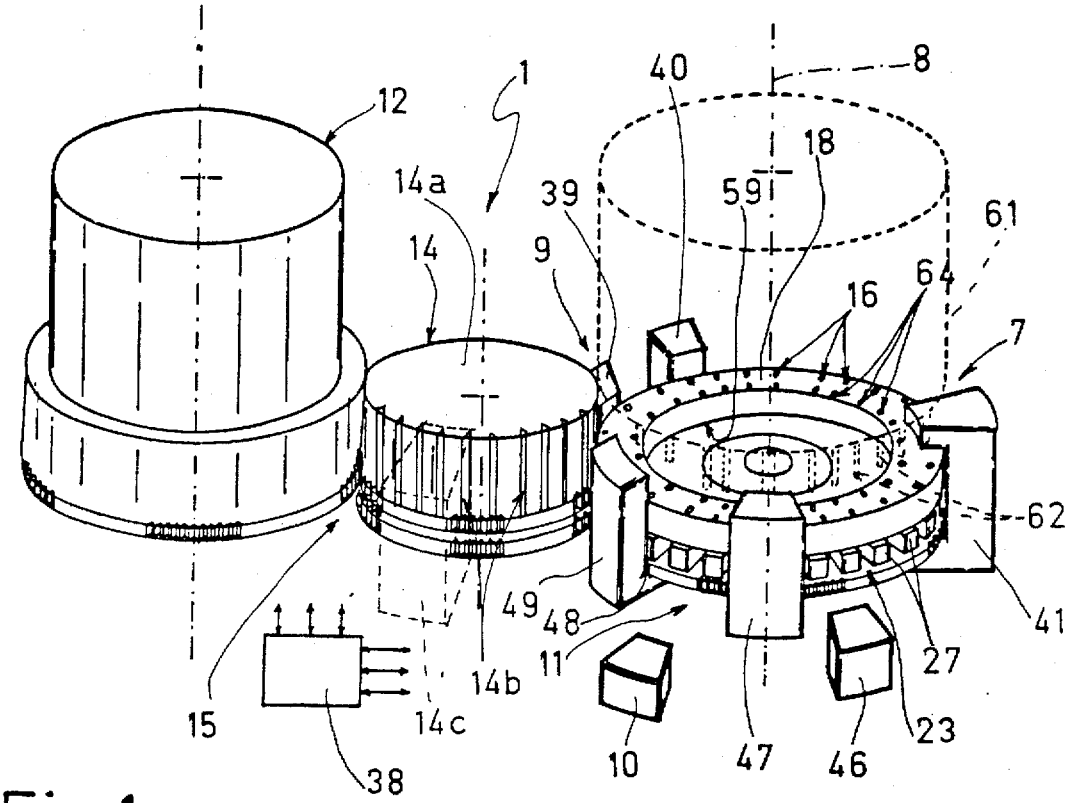
Fig.1
Fig.2
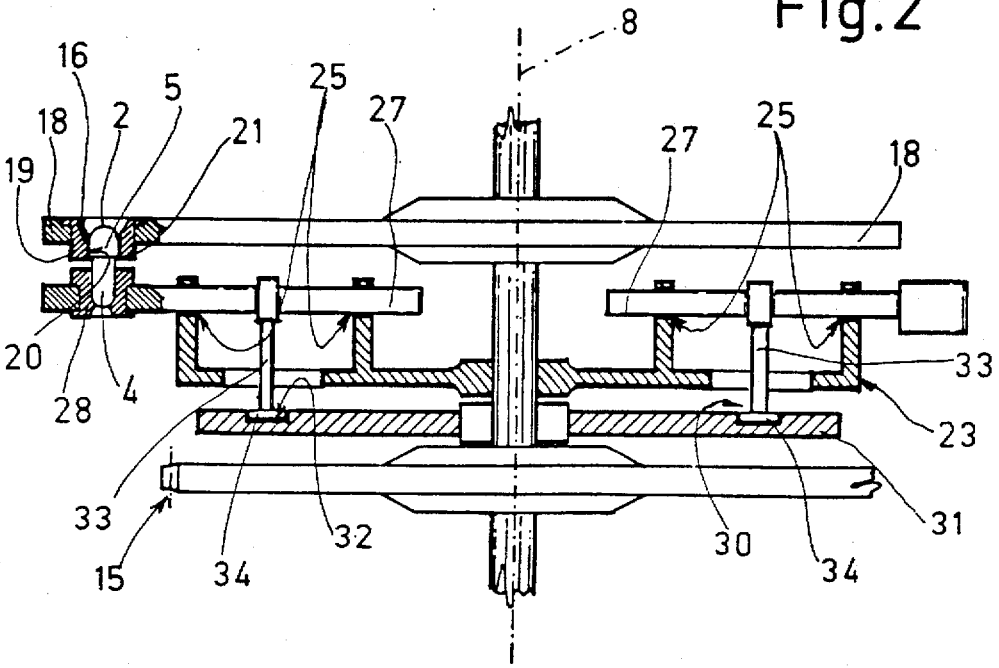

METERING MACHINE

BACKGROUND OF THE INVENTION

The present invention relates to a capsule filling machine.

Oral medicines include hard-gel capsules defined by two substantially cylindrical shells with a U-shaped radial section, which are fitted one inside the other to define a chamber for one or more drugs in the form of powder, granules or minute tablets. For the sake of simplicity, hereinafter, the smaller-radius shell will be referred to as the bottom shell, and the larger-radius shell, which is fitted onto the bottom one to form the chamber, as the lid.

Medicines of this sort are produced using filling machines featuring an electronic central control unit and at least one filling assembly, which comprises a number of bushes, each for receiving, by means of a transfer member, a closed empty capsule positioned with the lid facing upwards. The filling assembly also comprises a capsule opening device; a feed-box containing the drug; a number of metering members; a capsule closing device; and a reject device for expelling any faulty capsules. At the transfer member, the filling machine normally also comprises a capsule detecting device for detecting and informing the closing device of any bushes without the respective capsules.

Once the lid is removed, each bottom shell is fed, inside a respective bush, along a filling path, at the end of which, the bottom shell containing the drug is closed with the respective lid, and the capsule is fed to a packing machine.

The above method provides for a high degree of flexibility of the production line by enabling the production of different types of drugs according to the dosage set and the type of drug used.

On the other hand, machines of the above type present several drawbacks, particularly when filling the bottom shells with powdered products, which must be stirred continuously to prevent lumps forming, and which, when stirred and metered out, are dispersed and settle on the machine components and inside the bushes, thus resulting in severe wear of the moving parts of the machine, and in increasing friction between the bottom shells and lids and the respective bushes. Such friction may result in the bottom shells or lids adhering to the respective bushes and, in the case of severe friction, in the capsules being torn when opened or closed, thus resulting in partial or even total clogging of the bushes. As dispersion of the powder is impossible to eliminate, the bottom shell and lid bushes must be cleaned frequently to remove any encrusted powder or hard-gel fragments preventing smooth seating of the bottom shells or lids. Which cleaning operation is performed manually, as the necessity arises, after stopping the machine.

Cleaning the bushes is a repetitive operation requiring no particular skill on the part of the operator, who simply swabs the inside of the bushes in the capsule insertion or withdrawal direction.

Moreover, on account of the slack between the bushes and capsules, the resultant of the forces acting on the lid may be other than zero when the lid is removed from the bottom shell, so that the lid springs back to its original shape and slips out of the respective bush, thus preventing the bottom shell containing the drug from being closed. As this would go unnoticed by the machine, the bottom shell would obviously be supplied to the packing machine, thus causing various problems to the relative devices, in addition, of course, to further dispersing the drug within the filling assembly.

SUMMARY OF THE INVENTION

It is an object of the present invention to provide a capsule filling machine designed to overcome the aforementioned drawbacks.

According to the present invention, there is provided a machine for filling capsules, each capsule comprising a bottom shell and a lid, both hollow and substantially cylindrical, and fitted one inside the other; the machine comprising a supply unit for supplying said capsules and defining an orderly succession of capsules arranged in a given manner; a filling assembly located downstream from said supply unit in a preferred traveling direction of said capsules; ordering means for optimizing operation of said filling assembly; and first control means cooperating with said ordering means to determine transfer of said capsules from said supply unit to said filling assembly; said filling assembly comprising an input station and an output station for said capsules; and a first and a second seat for each of said capsules, and for respectively housing a said lid and a said bottom shell; said filling assembly also comprising filling means for metering substantially particulate material into said bottom shells between said input and output stations; and a closing device located upstream from said output station to fit said lids and respective bottom shells containing said material one inside the other; characterized in that said filling assembly also comprises at least one cleaning station located downstream from said output station; and cleaning means being provided at said cleaning station, and cooperating with said first control means, via said ordering means, to clean said first and/or second seats

BRIEF DESCRIPTION OF THE DRAWINGS

A number of non-limiting embodiments of the present invention will be described by way of example with reference to the accompanying drawings, in which:

FIG. 1 shows a schematic view in perspective of a machine in accordance with the teachings of the present invention;

FIG. 2 shows a larger-scale axial section, with parts removed for clarity, of a detail in FIG. 1;

DETAILED DESCRIPTION OF THE INVENTION

Number 1 in FIG. 1 indicates a machine for filling hard-gel capsules 2, and which may be used to advantage in the pharmaceutical industry.

Figure 4:
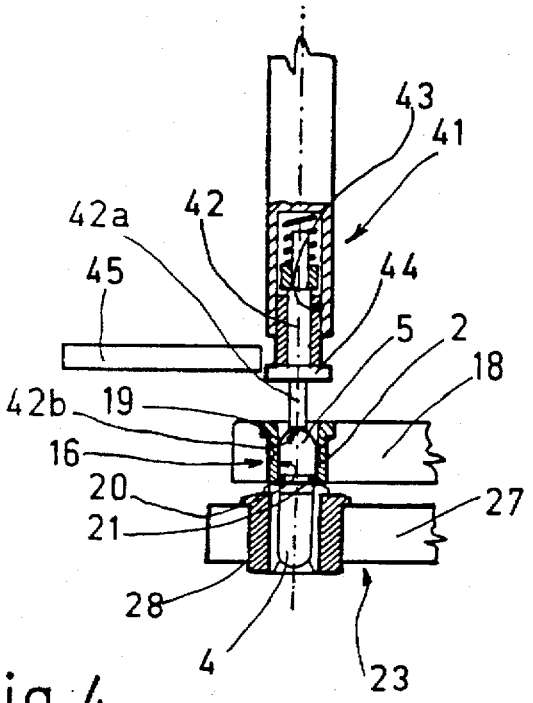

Each capsule 2 (FIGS. 2 and 4) comprises two substantially cylindrical shells, which fit one inside the other to define a chamber for normally pharmaceutical material in the form of powder, granules or minute tablets. More specifically, a first shell defines a bottom shell 4, and the second shell defines a lid 5, which, as shown in FIG. 2, is fittable onto bottom shell 4 by having an inside radius substantially identical to the outside radius of bottom shell 4.

Machine 1 comprises a filling assembly 7 rotating freely about a vertical axis 8, and which receives an orderly succession of closed empty capsules 2 at a respective input station 9.

As described later on, assembly 7 provides for feeding capsules 2 about axis 8 to meter powdered pharmaceutical material into bottom shells 4, and for successively feeding the same capsules 2 to a packing machine 10 via a respective output station 11 located substantially 270° downstream from station 9.

Machine 1 also comprises a known supply unit 12 rotating freely about an axis parallel to axis 8, and in turn comprising a known feedbox (not shown) containing capsules 2. It should be pointed out that, in use, capsules 2 are expelled from unit 12 substantially vertically, with lid 5 upwards and respective bottom shell 4 downwards.

Unit 12 and assembly 7 are activated by a pneumatic transfer device 14 substantially defined by a drum 14*a* rotated about a vertical axis by a known motor (not shown). More specifically, device 14 is connected to unit 12 and assembly 7 via a gear transmission 15 beneath machine 1, so that unit 12 and assembly 7 rotate at all times in opposition to each other. Device 14 comprises a number of seats 14*b* equally spaced about the periphery of drum 14*a*, and each for receiving and transferring a respective capsule 2 from unit 12 to assembly 7; and a detecting member 14*c* located peripherally between unit 12 and assembly 7 in a preferred traveling direction (anticlockwise in FIG. 1) of capsules 2 on drum 14*a*, and for detecting the presence of capsules 2 inside respective seats 14*b*. Machine 1 also comprises an electronic central control unit 38 for coordinating the operation of unit 12, assembly 7 and device 14 to achieve optimum performance of machine 1; and detecting member 14*c* is connected electrically to central control unit 38 for the reasons described later on.

With reference to FIG. 1, assembly 7 comprises a number of seats 16 equally spaced about axis 8, and each for receiving, by force of gravity, a respective capsule 2 from unit 12. More specifically, assembly 7 comprises an annular body 18 having a number of vertical holes, each housing a respective bush 19. Each bush 19 comprises an axial hole 20 of a diameter substantially equal to the outside diameter of lid 5, and which defines a seat 16 and is defined at the bottom by an annular projection 21 defining a stop for lid 5 as capsule 2 drops down inside hole 20. Annular body 18 rotates at constant angular speed about axis 8, and assembly 7 also comprises a supporting member 23 coaxial with axis 8, located beneath and rigidly connected to annular body 18, and comprising a number of substantially fork-shaped radial guides 25 equally spaced about axis 8. More specifically, each guide 25 corresponds to a respective bush 19, and supports in radially-sliding manner an arm 27; and each arm 27 comprises, beneath respective bush 19, a vertical hole housing a bush 28 of an inside diameter substantially equal to the outside diameter of bottom shell 4.

The presence of detecting member 14*c* and the rigidity of transmission 15 enable central control unit 38 to determine a seat 16 lacking capsule 2.

Figure 3:
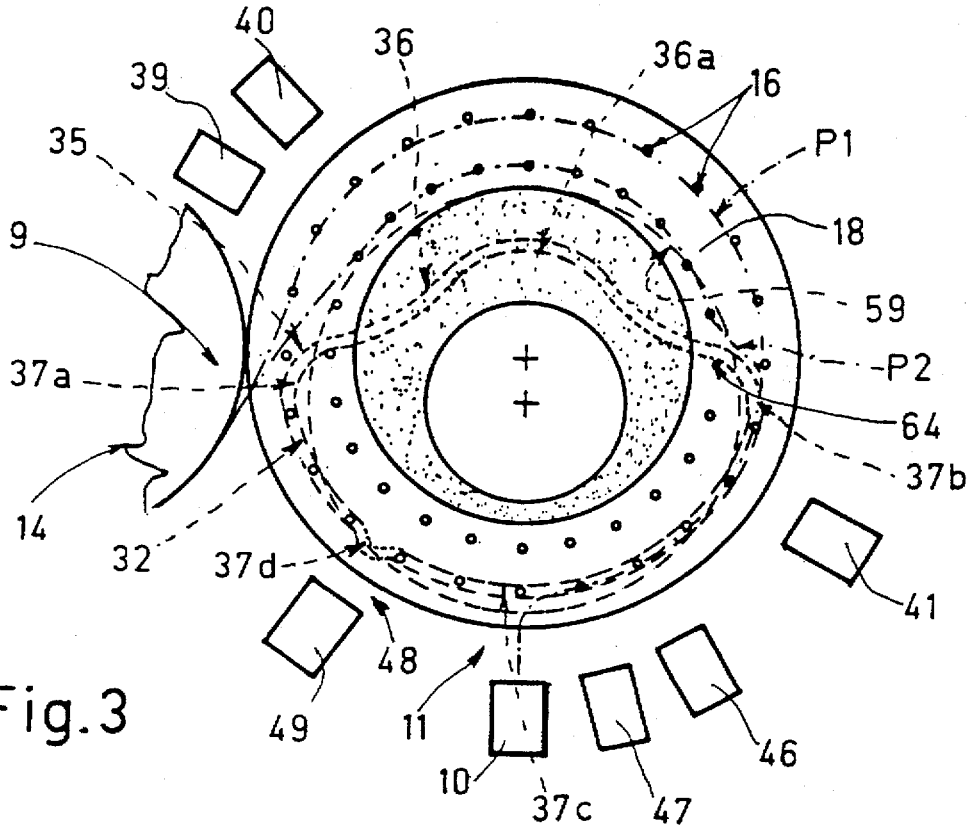
FIG. 3 shows a smaller-scale plan view, with parts removed for clarity, of the FIG. 2 detail.

Assembly 7 also comprises a cam and tappet device 30 located beneath member 23 and in turn comprising a fixed cam 31 moving anticlockwise with respect to annular body 18. Cam 31 comprises a horizontal annular groove 32 extending about axis 8, and each arm 27 comprises, at a central portion, a substantially vertical, downward-facing pin 33 fitted on the end with a tappet roller 34 engaging groove 32. Cam 31 provides for controlling the radial movement of arms 27, for which purpose, and as shown in FIG. 3, groove 32 comprises an input portion 35 extending clockwise from station 9 and having a filling portion 36 in turn comprising a circular central portion 36*a* centered about axis 8 and for maintaining bush 28 at a constant distance from axis 8. Portion 36*a* is defined by two outwardly-concave portions for moving bush 19 towards axis 8; and portion 35 is defined at the ends by two inwardly-concave portions 37*a*, 37*b* located respectively up- and downstream (clockwise in FIG. 3) from portion 35 and down- and upstream from a circular portion 37*c* concentric with axis 8. It should be pointed out that portions 36*a* and 37*c* have different radii, and more specifically, the radius of portion 36*a* is smaller than that of portion 37*c*. Upstream from portion 37*a* (clockwise in FIG. 3), groove 32 comprises a portion 37*d*, which is concave inwards of groove 32, connects portions 37*a* and 37*b*, and provides for moving bush 28 outwards of annular body 18, reaching a maximum travel downstream from station 11.

Assembly 7 also comprises a number of operating and control devices located one after the other between stations 9 and 11 and along the periphery of cam 31 (clockwise in FIG. 3), and which act successively on the respective facing capsules 2 under control of electronic central control unit 38 (shown schematically by a rectangle in FIG. 1).

More specifically, the first device located immediately downstream from station 9 (clockwise in FIG. 3) is a known device 39 (shown schematically in FIG. 3) for opening capsules 2, and which is employed on filling machines produced by the Applicant and marketed by the name of MG2 G37/N as per catalogue 227009. Device 39 comprises a known pneumatic suction member (not shown) for separating bottom shell 4 by suction from respective lid 5, which is retained inside bush 19 by projection 21.

Assembly 7 further comprises a control member 40 located immediately downstream from device 39 and connected electrically to central control unit 38, which member 40 is known owing to its being used on the MG2 G37/N machine. Device 39 provides for determining separation of bottom shells 4 from lids 5.

Downstream from member 40 (clockwise in FIG. 3), assembly 7 comprises a control member 41 (FIG. 4) connected to central control unit 38, and in turn comprising a substantially cylindrical feeler 42. More specifically, feeler 42 is positioned vertically, slides axially from an idle position inside a vertical guide 43, is moved downwards by a known linear actuator (not shown) in opposition to a spring, and comprises a free end 42*a* projecting downwards from guide 43 and terminating at the bottom with a sensitive appendix 42*b*. Over appendix 42*b*, end 42*a* comprises an annular collar 44, which also acts as a limit stop for the upward movement of feeler 42, and member 41 comprises a proximity sensor 45 (shown schematically in FIG. 4) for detecting the vertical position of collar 44. In actual use, the known actuator (not shown) of member 41 is capable of moving feeler 42 downwards to a point corresponding to the downward-facing surface of annular body 18, but is arrested on encountering an obstacle, normally a lid 5, and supplies central control unit 38 with a logic signal indicating the presence or absence of lid 5, or the state of lid 5, as explained later on, depending on the stop position of the feeler inside bush 19.

Downstream from member 41, assembly 7 comprises a known closing device 46 (shown schematically in FIGS. 1 and 3) connected electrically to central control unit 38, and for closing capsules 2 by pushing bottom shell 4 upwards inside lid 5, which at the same time is maintained contacting projection 21 by device 46.

Between device 46 and station 11, assembly 7 comprises an expulsion member 47, which, like device 39 and member 40, is known and therefore only shown schematically, and which provides for expelling the content of bushes 19 failing to conform with given capsule 2 production standards, e.g. crushed capsules 2, bottom shells 4 containing the pharmaceutical material but without lids 5, or otherwise defective capsules 2.

On the opposite side of station 11 to member 47, assembly 7 comprises a cleaning station 48 comprising a cleaning device 49 (FIG. 5) in turn comprising a vertically-moving assembly 50 located over the periphery of annular body 18. On the axis 8 side, assembly 50 is fitted integrally with a vertical cleaning member 51 defined by a vertical rod extending towards annular body 18, and the axis of which intersects the circumference described by the axes of bushes 19 as annular body 18 rotates (clockwise in FIG. 3) about axis 8. The downward-facing free end 52 of rod 51 comprises a substantially cylindrical swab 53 of a radius approximately equal to but no smaller than the radius of a bush 19. Assembly 50 is movable between a raised position, in which end 52 is located over annular body 18, and a lowered position (FIG. 5), in which swab 53 is located at least partly beneath annular body 18.

Figure 5:
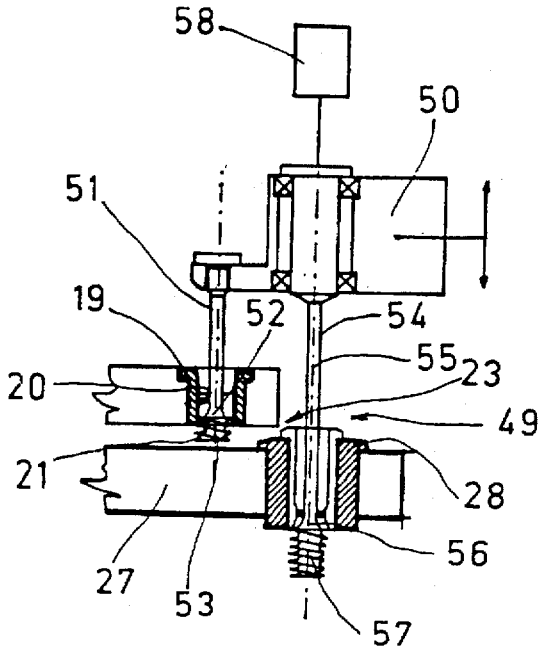
FIGS. 4 and 5 show larger-scale axial sections, with parts removed for clarity, of details in FIG. 1.

On the opposite side of rod 51 to axis 8, assembly 50 comprises a vertical cylindrical hole housing, via the interposition of rolling bearings, a further cleaning member 54 comprising a downward-extending vertical rod 55 longer than rod 51, and the free end 56 of which comprises a swab 57 substantially identical to swab 53. As shown in FIG. 5, device 49 comprises an actuator 58, which provides for rotating rod 55 about its longitudinal axis to thoroughly clean bush 28, and which is operated selectively whenever assembly 50 is moved from the raised to the lowered position.

Assembly 7 also comprises a substantially annular feedbox 59 containing a powdered drug representing said pharmaceutical material, and which is open at the top and located eccentrically with respect to axis 8. Assembly 7 also comprises a metering head 61 coaxial with and rotating about axis 8, and which in turn comprises a number of metering members 62 equally spaced about axis 8. Each member 62 is movable vertically between a lowered position in which a bottom opening of member 62 is immersed inside the powdered drug in feedbox 59, and a raised position in which the bottom opening of member 62 is located over annular body 18.

Operation of machine 1 will now be described as of the steady-state condition in which capsules 2 are supplied continuously to assembly 7 by unit 12.

For the reasons already stated, assembly 7 is tangent to and rotates in opposition to device 14 (assembly 7 clockwise and device 14 anticlockwise in FIG. 1), and transmission 15 provides for feeding capsules 2 on assembly 7 and device 14 at substantially the same speed through station 9. As a capsule 2 is dropped down into a respective bush 19 at station 9, the respective bottom shell 4 is engaged by suction by device 39 and so separated from respective lid 5; and, in the meantime, roller 34 of respective arm 27 travels along portion 35 upstream from portion 36.

At this point, control member 40 determines capsule 2 has been opened, and transmits a corresponding logic signal to central control unit 38. Roller 34 of the arm 27 supporting bottom shell 4 then engages the outwardly-concave portions defining portion **36*a*, so that arm 27 is moved radially along respective guide 25 to position bottom shell 4 beneath a hole 64 formed in annular body 18. Hole 64 is one of a number of holes 64 equally spaced about axis 8 along a circumference concentric with and inwards of the circumference defined by holes 20, and each hole 64 is aligned radially with a respective hole 20**.

As roller 34 engages portion **36*a*, a metering member 62 feeds the respective dosage of pharmaceutical material through hole 64 into bottom shell 4, after which, roller 34 engages portion 37*c* to move arm 27 radially so that bushes 19 and 28, and therefore bottom shell 4 and lid 5, are positioned coaxially and maintained in this position until capsule 2 is closed and up to a point beyond station 11. In the meantime, the known actuator (not shown) of control member 41 moves feeler 42 downwards to determine the presence of lid 5 inside bush 28; and feeler 42 supplies central control unit 38 with a different logic signal depending on whether appendix 42*b* contacts the top of a lid 5, or penetrates inside bush 19 without encountering any obstacle, or partially penetrates bush 19 encountering a damaged lid 5** on the way.

At this point, central control unit 38, on the basis of the two logic signals received from members 40 and 41, activates either expulsion member 47, to expel the bottom shell 4 with a damaged or no lid 5, or closing device 46. If expelled, shell 4 is collected downstream from station 11; if closed, capsule 2 is fed to packing machine 10.

At this point, roller 34 engages portion **37*d* to move arm 27 radially outwards so that respective bush 28 is positioned clear of annular body 18 and freely accessible by swab 57 of cleaning device 49 at station 48**.

That is, on receiving logic signals indicating a malfunction (e.g. the absence of a capsule 2 inside respective seat 16, as detected by member **14*c*; an unopened capsule 2 crushed by the radial movement of arm 27, as detected by device 40; a missing lid 5, as detected by member 41; a shell 4 or lid 5 damaged during closure; or a leftover shell 4), central control unit 38 stops machine 1 with bushes 19 and 28 positioned beneath swabs 53 and 57 to remove any gel fragments of crushed shell 4 or lid 5**.

It should be pointed out that, even in the event none of the above malfunctions is detected, central control unit 38 also stops the machine to operate cleaning device 49 at regular intervals, as set by the operator of machine 1 according to the chemical characteristics of the drug with which shells 4 are filled, to prevent malfunctioning caused by deposits accumulating on the walls of bushes 19 and 28.

Lids 5 and bottom shells 4 are therefore fed about axis 8 along respective paths P1 and P2 located at least in different planes; path P1 being substantially circular, and path P2 curving variously and only comprising circular portions substantially identical to the corresponding portions of path P1 at stations 9 and 11.

By virtue of the combined operation, coordinated by central control unit 38, of detecting member **14*c*, device 39, members 40 and 41, and device 49, machine 1 is only stopped when absolutely necessary, thus greatly reducing cycle time. Moreover, by reducing the operator intervention rate, cleaning device 49 provides for greatly improving the safety of machine 1**.

Clearly, changes may be made to machine 1 as described and illustrated herein without, however, departing from the scope of the present invention.

I claim:

1. A machine for filling capsules, each capsule (2) comprising a bottom shell (4) and a lid (5), both hollow and substantially cylindrical, and fitted one inside the other; the machine comprising a supply unit (12) for supplying said capsules (2) and defining an orderly succession of capsules (2) arranged in a given manner; a filling assembly (7) located downstream from said supply unit (12) in a preferred traveling direction of said capsules (2); ordering means (38)

for optimizing operation of said filling assembly (7); and first control means (14*c*) cooperating with said ordering means (38) to determine transfer of said capsules (2) from said supply unit (12) to said filling assembly (7); said filling assembly (7) comprising an input station (9) and an output station (11) for said capsules (2); and a first and a second seat (19, 28) for each of said capsules (2), and for respectively housing a said lid (5) and a said bottom shell (4); said filling assembly (7) also comprising filling means (62) for metering substantially particulate material into said bottom shells (4) between said input and output stations (9, 11); and a closing device (46) located upstream from said output station (11) to fit said lids (5) and respective bottom shells (4) containing said material one inside the other; characterized in that said filling assembly (7) also comprises at least one cleaning station (48) located downstream from said output station (11); and cleaning means (49) being provided at said cleaning station (48), and cooperating with said first control means (14*c*), via said ordering means (38), to clean said first and/or second seats (19, 28).

2. A machine as claimed in claim 1, characterized in that, downstream from said input station (9) in said preferred traveling direction, said filling assembly (7) comprises an opening device (39) for opening empty said capsules (2) oriented in a given manner; said ordering means (38) being defined by an electronic central control unit (38); and said cleaning means (49) being connected electrically to said central control unit (38) so as to be activated automatically under control of said central control unit (38).

3. A machine as claimed in claim 1, characterized by comprising second control means (41) located upstream from said output station (11) to determine the content of at least said first seats (19).

4. A machine as claimed in claim 3, characterized in that said second control means (41) are connected electrically to said central control unit (38) to condition operation of said cleaning means (49) via said central control unit (38).

5. A machine as claimed in claim 3, characterized in that said first and second seats (19, 28) respectively receive said lids (5) and said bottom shells (4) in a given direction; said cleaning means (49) comprising at least one cleaning member (51, 54) for engaging at least one of said first and second seats (19, 28) and movable in said given direction.

6. A machine as claimed in claim 4, characterized in that said given direction is a substantially vertical direction; said second control means (41) comprising a feeler member (42) movable downwards and parallel to said given direction from an idle position; said feeler member determining the presence and state of said lids (5) inside said first seats (19); said cleaning member (51, 54) terminating with an appendix (52, 56) having brush means (53, 57) rotated selectively about an axis substantially parallel to said given direction.

7. A machine as claimed in claim 5, characterized in that said feeler member (42) comprises end sensor means (42*b*) at the bottom; proximity sensor means (45) being provided to determine the position of said feeler member (42) in said given direction and inside a said first seat (19).

8. A machine as claimed in claim 3, characterized in that said filling assembly (7) feeds said bottom shells (4) and said lids (5) along respective first and second paths (P2, P1) extending about a substantially vertical axis (8) of rotation.

9. A machine as claimed in claim 7, characterized in that said first and second paths (P1, P2) are selectively offset radially and angularly in relation to each other downstream from said input station (9) and upstream from said output station (11) in said traveling direction.

10. A machine as claimed in claim 1, characterized in that said filling assembly (7) comprises an opening device (39) for opening said capsules (2), for separating said bottom shells (4) by suction from the respective said lids (5), and located about said axis (8), downstream from said input station (9); and a closing device (46) located upstream from said output station (11), and for pushing said bottom shells (4) into the respective said lids (5) to close said capsules (2).

11. A machine as claimed in claim 9, characterized in that said filling assembly (7) comprises third control means (40) for determining separation of said bottom shells (4) from the respective said lids (5); said third control means (40) being connected electrically to said electronic central control unit (38) to cooperate with said cleaning means (49) via said electronic central control unit (38).

* * * * *